US009951910B2

(12) United States Patent
Reier

(10) Patent No.: US 9,951,910 B2
(45) Date of Patent: Apr. 24, 2018

(54) LED LAMP WITH BASE HAVING A BIASED ELECTRICAL INTERCONNECT

(71) Applicant: Cree, Inc., Durham, NC (US)

(72) Inventor: Bart P. Reier, Cary, NC (US)

(73) Assignee: Cree, Inc., Durham, NC (US)

( * ) Notice: Subject to any disclaimer, the term of this patent is extended or adjusted under 35 U.S.C. 154(b) by 77 days.

(21) Appl. No.: 14/281,106

(22) Filed: May 19, 2014

(65) Prior Publication Data

US 2015/0330580 A1 Nov. 19, 2015

(51) Int. Cl.

| | |
|---|---|
| ***F21K 99/00*** | (2016.01) |
| ***F21V 23/02*** | (2006.01) |
| ***F21V 23/00*** | (2015.01) |
| ***F21K 9/23*** | (2016.01) |
| ***F21K 9/238*** | (2016.01) |
| *F21K 9/232* | (2016.01) |
| *F21K 9/235* | (2016.01) |
| *F21K 9/237* | (2016.01) |
| *F21V 19/00* | (2006.01) |
| *F21Y 115/10* | (2016.01) |
| *F21Y 107/30* | (2016.01) |

(52) U.S. Cl.

CPC ..... *F21K 9/23* (2016.08); *F21K 9/238* (2016.08); *F21V 23/006* (2013.01); *F21V 23/02* (2013.01); *F21K 9/232* (2016.08); *F21K 9/235* (2016.08); *F21K 9/237* (2016.08); *F21V 19/004* (2013.01); *F21Y 2107/30* (2016.08); *F21Y 2115/10* (2016.08)

(58) Field of Classification Search

CPC ..... F21K 9/135; F21K 9/1355; F21K 9/30; F21K 9/235; F21K 9/237; F21K 9/238; F21V 23/006; F21V 23/02

See application file for complete search history.

(56) References Cited

U.S. PATENT DOCUMENTS

| | | | |
|---|---|---|---|
| 3,581,162 | A | 5/1971 | Wheatley |
| 5,463,280 | A | 10/1995 | Johnson |
| 5,561,346 | A | 10/1996 | Byrne |
| 5,585,783 | A | 12/1996 | Hall |
| 5,655,830 | A | 8/1997 | Ruskouski |
| 5,688,042 | A | 11/1997 | Madadi et al. |
| 5,806,965 | A | 9/1998 | Deese |
| 5,947,588 | A | 9/1999 | Huang |
| 5,949,347 | A | 9/1999 | Wu |
| 6,220,722 | B1 | 4/2001 | Begemann |

(Continued)

FOREIGN PATENT DOCUMENTS

| | | | | |
|---|---|---|---|---|
| CA | 2779215 | A1 * | 12/2013 | ..... H01R 33/09 |
| EP | 1058221 | A2 | 12/2000 | |

(Continued)

*Primary Examiner* — Jong-Suk (James) Lee
*Assistant Examiner* — Colin Cattanach
(74) *Attorney, Agent, or Firm* — Dennis J. Williamson; Moore & Van Allen PLLC

(57) ABSTRACT

A LED lamp includes an at least partially optically transmissive enclosure and a base. A LED assembly includes at least one LED, where the LED is located in the enclosure and is operable to emit light when energized through an electrical path from the base. An electronics board is in the electrical path and is coupled to the base by an electrical interconnect comprising at least one base-side contact that is biased into engagement with the base.

12 Claims, 13 Drawing Sheets

(56) References Cited

U.S. PATENT DOCUMENTS 6,227,679 B1 5/2001 Zhang et al.
6,234,648 B1 5/2001 Borner et al.
6,250,774 B1 6/2001 Begemann et al.
6,276,822 B1 8/2001 Bedrosian et al.
6,465,961 B1 10/2002 Cao
6,523,978 B1 2/2003 Huang
6,550,953 B1 4/2003 Ichikawa et al.
6,634,770 B2 10/2003 Cao
6,659,632 B2 12/2003 Chen
6,709,132 B2 3/2004 Ishibashi
6,733,319 B1 * 5/2004 Jørgensen ..... H01R 4/48 439/329
6,803,607 B1 10/2004 Chan et al.
6,848,819 B1 2/2005 Arndt et al.
6,864,513 B2 3/2005 Lin et al.
6,948,829 B2 9/2005 Verdes et al.
6,982,518 B2 1/2006 Chou et al.
7,048,412 B2 5/2006 Martin et al.
7,080,924 B2 7/2006 Tseng et al.
7,086,756 B2 8/2006 Maxik
7,086,767 B2 8/2006 Sidwell et al.
7,144,135 B2 12/2006 Martin et al.
7,165,866 B2 1/2007 Li
7,172,314 B2 2/2007 Currie et al.
7,354,174 B1 4/2008 Yan
7,396,142 B2 7/2008 Laizure, Jr. et al.
7,600,882 B1 10/2009 Morejon et al.
7,726,836 B2 6/2010 Chen
7,824,065 B2 11/2010 Maxik
7,892,031 B1 * 2/2011 Mostoller ..... H01J 5/50 313/317
7,965,023 B1 6/2011 Liang
8,021,025 B2 9/2011 Lee
8,253,316 B2 8/2012 Sun et al.
8,272,762 B2 9/2012 Maxik et al.
8,274,241 B2 9/2012 Guest et al.
8,277,082 B2 10/2012 Dassanayake et al.
8,282,249 B2 10/2012 Liang et al.
8,282,250 B1 10/2012 Dassanayake et al.
8,292,468 B2 10/2012 Narendran et al.
8,322,896 B2 12/2012 Falicoff et al.
8,371,722 B2 2/2013 Carroll
8,400,051 B2 3/2013 Hakata et al.
8,415,865 B2 4/2013 Liang et al.
8,421,320 B2 4/2013 Chuang
8,421,321 B2 4/2013 Chuang
8,421,322 B2 4/2013 Carroll et al.
8,427,037 B2 4/2013 Liang et al.
8,449,154 B2 5/2013 Uemoto et al.
8,502,468 B2 8/2013 Li et al.
8,556,465 B2 10/2013 Lee et al.
8,641,237 B2 2/2014 Chuang
8,653,723 B2 2/2014 Cao et al.
8,696,168 B2 4/2014 Li et al.
8,740,415 B2 6/2014 Wheelock
8,750,671 B1 6/2014 Kelly et al.
8,752,984 B2 6/2014 Lenk et al.
8,760,042 B2 6/2014 Sakai et al.
8,963,410 B2 * 2/2015 Wu ..... F21K 9/13 313/318.01
9,151,451 B2 * 10/2015 Yang ..... F21K 9/1355
9,212,801 B2 * 12/2015 Leung ..... F21V 23/06
2004/0201990 A1 10/2004 Meyer
2004/0264205 A1 * 12/2004 Tiesler ..... B60Q 3/0279 362/487
2009/0184618 A1 7/2009 Hakata et al.
2009/0218923 A1 * 9/2009 Gingrich, III ..... F21K 9/00 313/1
2009/0273939 A1 * 11/2009 Oesterheld ..... H05K 1/141 362/362
2010/0219735 A1 * 9/2010 Sakai ..... F21K 9/1355 313/46
2011/0028015 A1 * 2/2011 Mostoller ..... H01J 5/50 439/280
2011/0133652 A1 * 6/2011 Chen ..... F21V 19/001 315/112
2011/0273102 A1 11/2011 Van De Ven et al.
2012/0040585 A1 2/2012 Huang
2012/0056557 A1 * 3/2012 Li ..... F21K 9/1355 315/294
2012/0147608 A1 * 6/2012 Kawagoe ..... F21V 5/007 362/294
2012/0217870 A1 * 8/2012 Soni ..... F21K 9/135 315/32
2012/0230034 A1 * 9/2012 Boomgaarden ..... F21V 3/02 362/294
2012/0314422 A1 * 12/2012 Dong ..... F21K 9/1355 362/311.02
2013/0026923 A1 1/2013 Athalye et al.
2013/0069535 A1 3/2013 Athalye
2013/0069547 A1 3/2013 Van De Ven et al.
2013/0128573 A1 * 5/2013 Leung ..... F21V 23/06 362/235
2013/0135858 A1 * 5/2013 Wu ..... F21V 29/20 362/235
2013/0162149 A1 6/2013 Van De Ven et al.
2013/0162153 A1 6/2013 Van De Ven et al.
2013/0169159 A1 7/2013 Lys
2013/0176708 A1 * 7/2013 Mostoller ..... F21V 19/0055 362/95
2013/0201696 A1 * 8/2013 Hisayasu ..... F21V 29/004 362/363
2013/0257278 A1 * 10/2013 DeVore ..... H01J 5/54 315/113
2013/0026925 A1 11/2013 Ven et al.
2013/0293135 A1 11/2013 Hu et al.
2014/0078753 A1 * 3/2014 Araki ..... F21V 23/006 362/373
2014/0300269 A1 * 10/2014 Wu ..... F21K 9/13 313/318.01
2014/0307427 A1 * 10/2014 Joo ..... F21V 15/06 362/186
2015/0062928 A1 * 3/2015 Mostoller ..... F21K 9/00 362/363
2015/0062929 A1 * 3/2015 Mostoller ..... F21K 9/00 362/363
2015/0070908 A1 * 3/2015 Yang ..... F21K 9/1355 362/362
2015/0070910 A1 * 3/2015 Yang ..... F21V 19/045 362/363
2015/0117037 A1 * 4/2015 Fan ..... F21K 9/1355 362/375

FOREIGN PATENT DOCUMENTS

EP 0890059 B1 6/2004
GB 2345954 A 7/2000
JP H09265807 A 10/1997
JP 2000173304 A 6/2000
JP 2001118403 A 4/2001
JP 2007059930 A 3/2007
JP 2008288183 A 11/2008
JP 2009117346 A 5/2009
JP 3153766 U 9/2009
JP 2009277586 A 11/2009
WO 0124583 A1 4/2001
WO 0160119 A2 8/2001
WO 2012011279 A1 1/2012
WO 2012031533 A1 3/2012

* cited by examiner

LED LAMP WITH BASE HAVING A BIASED ELECTRICAL INTERCONNECT

BACKGROUND

Light emitting diode (LED) lighting systems are becoming more prevalent as replacements for older lighting systems. LED systems are an example of solid state lighting (SSL) and have advantages over traditional lighting solutions such as incandescent and fluorescent lighting because they use less energy, are more durable, operate longer, can be combined in multi-color arrays that can be controlled to deliver virtually any color light, and generally contain no lead or mercury. A solid-state lighting system may take the form of a lighting unit, light fixture, light bulb, or a "lamp."

An LED lighting system may include, for example, a packaged light emitting device including one or more light emitting diodes (LEDs), which may include inorganic LEDs, which may include semiconductor layers forming p-n junctions and/or organic LEDs, which may include organic light emission layers. Light perceived as white or near-white may be generated by a combination of red, green, and blue ("RGB") LEDs. Output color of such a device may be altered by separately adjusting supply of current to the red, green, and blue LEDs. Another method for generating white or near-white light is by using a lumiphor such as a phosphor. Still another approach for producing white light is to stimulate phosphors or dyes of multiple colors with an LED source. Many other approaches can be taken.

An LED lamp may be made with a form factor that allows it to replace a standard incandescent bulb, or any of various types of fluorescent lamps. LED lamps often include some type of optical element or elements to allow for localized mixing of colors, collimate light, or provide a particular light pattern. Sometimes the optical element also serves as an enclosure for the electronics and or the LEDs in the lamp.

Since, ideally, an LED lamp designed as a replacement for a traditional incandescent or fluorescent light source needs to be self-contained; a power supply is included in the lamp structure along with the LEDs or LED packages and the optical components. A heatsink is also often needed to cool the LEDs and/or power supply in order to maintain appropriate operating temperature.

SUMMARY OF THE INVENTION

In some embodiments, a lamp comprises an at least partially optically transmissive enclosure and a base. A LED assembly comprises at least one LED where the LED assembly is located in the enclosure and the at least one LED is operable to emit light when energized through an electrical path from the base. An electronics board is in the electrical path where the electronics board is coupled to the base by an electrical interconnect comprising a first base-side contact that is biased into engagement with the base.

The electrical interconnect may comprise a second base-side contact that is biased into engagement with the base. The first base-side contact may be supported in an electrically insulated body. The body may comprise a board engagement member. The board engagement member may comprise a deformable resilient member that engages the electronics board. The deformable resilient member may create a bias force applied by the resilient member to the electronics board. The deformable resilient member may create a mechanical engagement between the body and the electronics board. One of the deformable resilient member and the electronics board may comprise a protrusion and the other one of the deformable resilient member and the electronics board may comprise a recess. The deformable resilient member and the electronics board may be connected by a snap-fit connection. The electrical interconnect may comprise a first board-side contact and a second board-side contact for connecting to an anode side and a cathode side of the electronics board. The first board-side contact and the second board-side contact may create an electrical connection to a first pad and a second pad of the electronics board. The first board-side contact and the second board-side contact may be deformed to engage the first pad and the second pad. The first base-side contact may be deformed to engage the base. The first base-side contact and the second base-side contact may create electrical contact couplings with the base. The base may comprise an Edison screw and the first base-side contact may create a first electrical contact coupling with an interior surface of the Edison screw and the second base-side contact may create a second electrical contact coupling with a centerline contact of the Edison screw. A guide may be formed in the base to orient the electronics board relative to the base. The electronics board may support at least one of a driver and a power supply.

In some embodiments a method of making a LED lamp comprises mounting an electrical interconnect onto a electronics board to create an electrical contact coupling between a board-side contact of the electrical interconnect an electrical path on the electronics board; inserting the electronics board into a base of a lamp such that a base-side contact on the electrical interconnect is deformed by and creates an electrical contact coupling with the base.

The base may comprise an Edison screw and the base-side contact may create the electrical contact coupling with the Edison screw. Inserting the electronics board into the base may deform a second base-side contact on the electrical interconnect to create a second electrical contact coupling with the base. The base may comprise an Edison screw and inserting the electronics board into the base may deform a second base-side contact on the electrical interconnect to create a second electrical contact coupling with the Edison screw.

DETAILED DESCRIPTION

Figure 3:
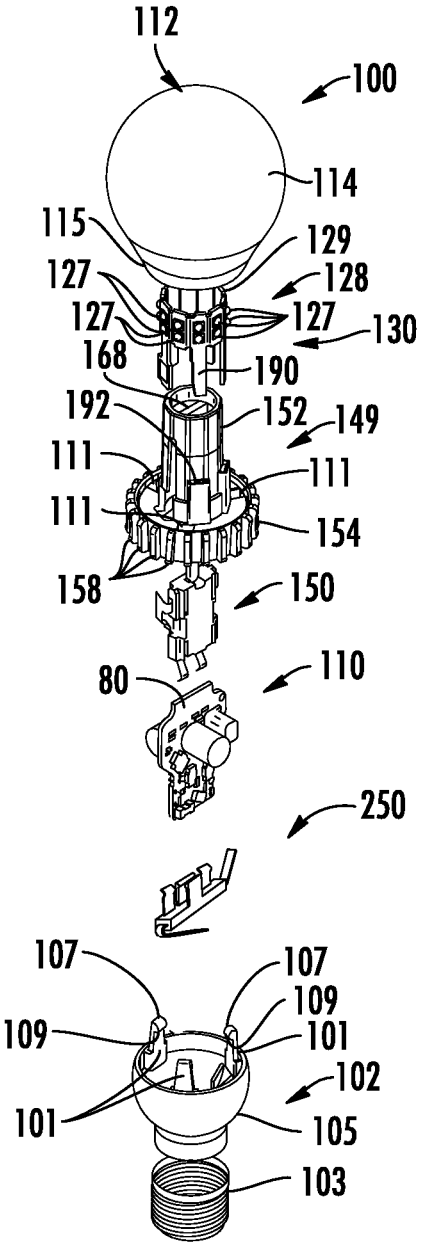
FIG. 3 is an exploded perspective view of the lamp of FIG. 1.
Figure 1:
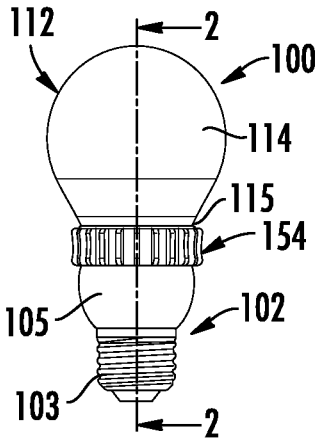
FIG. 1 is a front view of an embodiment of a LED lamp.
Figure 2:
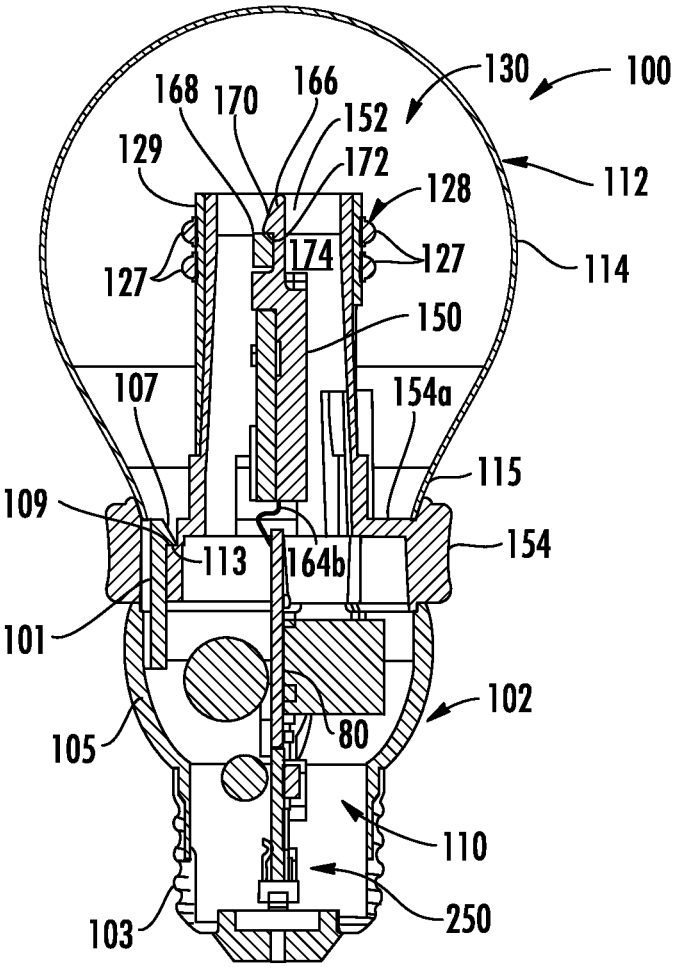
FIG. 2 is a section view taken along line 2-2 of FIG. 1.
Figure 4:
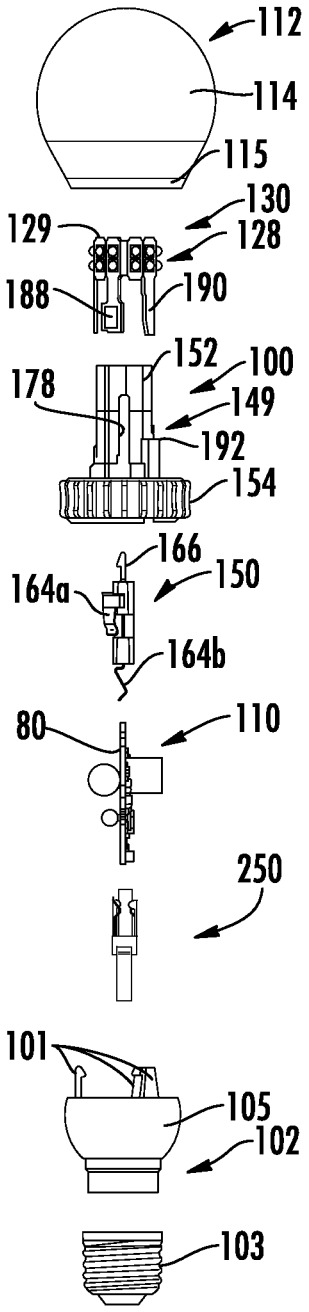
FIGS. 4 and 5 are exploded plan views of the lamp of FIG. 1 at different orientations of the lamp.
Figure 5:
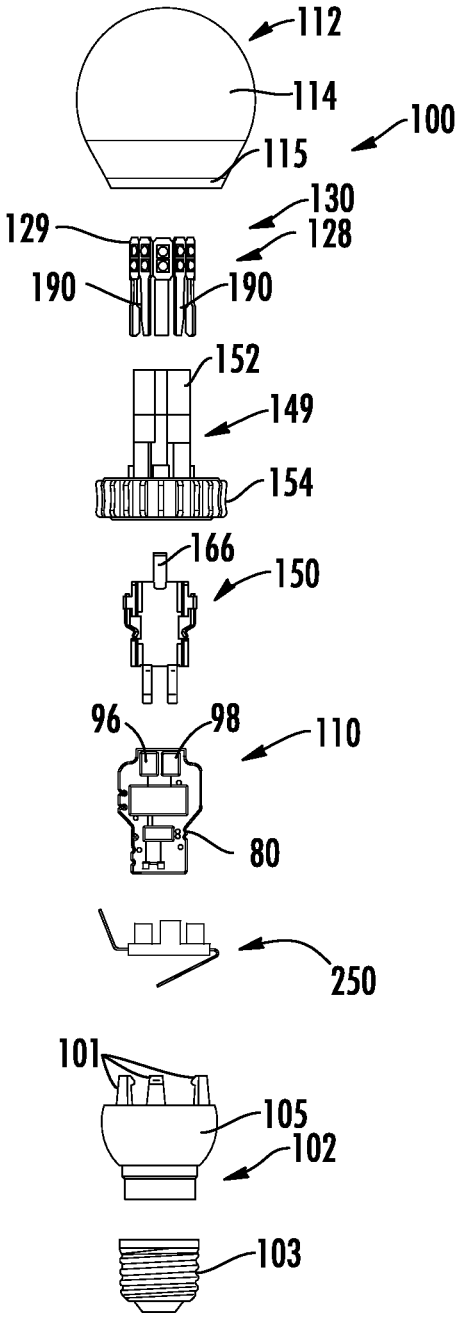

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

The terms "LED" and "LED device" as used herein may refer to any solid-state light emitter. The terms "solid state light emitter" or "solid state emitter" may include a light emitting diode, laser diode, organic light emitting diode, and/or other semiconductor device which includes one or more semiconductor layers, which may include silicon, silicon carbide, gallium nitride and/or other semiconductor materials, a substrate which may include sapphire, silicon, silicon carbide and/or other microelectronic substrates, and one or more contact layers which may include metal and/or other conductive materials. A solid-state lighting device produces light (ultraviolet, visible, or infrared) by exciting electrons across the band gap between a conduction band and a valence band of a semiconductor active (light-emitting) layer, with the electron transition generating light at a wavelength that depends on the band gap. Thus, the color (wavelength) of the light emitted by a solid-state emitter depends on the materials of the active layers thereof. In various embodiments, solid-state light emitters may have peak wavelengths in the visible range and/or be used in combination with lumiphoric materials having peak wavelengths in the visible range. Multiple solid state light emitters and/or multiple lumiphoric materials (i.e., in combination with at least one solid state light emitter) may be used in a single device, such as to produce light perceived as white or near white in character. In certain embodiments, the aggregated output of multiple solid-state light emitters and/or lumiphoric materials may generate warm white light output having a color temperature range of from about 2200K to about 6000K.

Solid state light emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in lighting devices as described herein may be accomplished by direct coating on solid state light emitter, adding such materials to encapsulants, adding such materials to lenses, by embedding or dispersing such materials within lumiphor support elements, and/or coating such materials on lumiphor support elements. Other materials, such as light scattering elements (e.g., particles) and/or index matching materials, may be associated with a lumiphor, a lumiphor binding medium, or a lumiphor support element that may be spatially segregated from a solid state emitter.

FIGS. 1 through 5 show an embodiment of a solid-state lamp, 100 comprising a LED assembly 130 with light emitting LEDs 127. Multiple LEDs 127 can be used together, forming an LED array 128. The LEDs 127 in the LED array 128 may comprise an LED die disposed in an encapsulant such as silicone, and LEDs which are encapsulated with a phosphor to provide local wavelength conversion. A wide variety of LEDs and combinations of LEDs may be used in the LED assembly 130. The LEDs 127 of the LED array 128 are operable to emit light when energized through an electrical path from base 102. The term "electrical path" is used to refer to the electrical path to the LED's 127, and may include an intervening power supply, drivers and/or other lamp electronics, and includes the electrical connection between the electrical connector that provides power to the lamp and the LED array. The term may also be used to refer to the electrical connection between the power supply and the LEDs and between the electrical connector to the lamp and the power supply. Electrical conductors run between the LEDs 127 and the lamp base 102 to carry both sides of the supply to provide critical current to the LEDs 127 as will be described. The LEDs 127 may be mounted on a submount 129 that may form a part of the electrical path to the LEDs. In the present invention the term "submount" is used to refer to the support structure that supports the individual LEDs or LED packages and in may comprise a printed circuit board, metal core printed circuit board, lead frame extrusion, flex circuit or the like or combinations of such structures. The electrical path runs between the submount 129 and the lamp base 102 to carry both sides of the supply to provide critical current to the LEDs 127.

Figure 8:
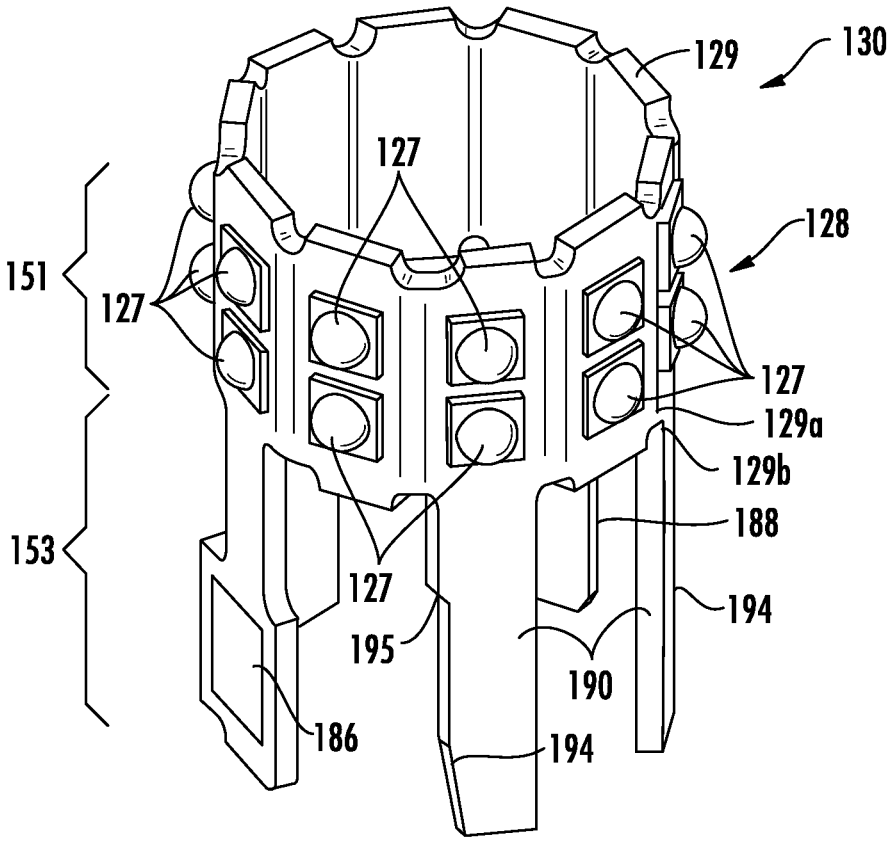
FIG. 8 is a perspective view of an LED assembly used in the lamp of FIG. 1.
Figure 9:
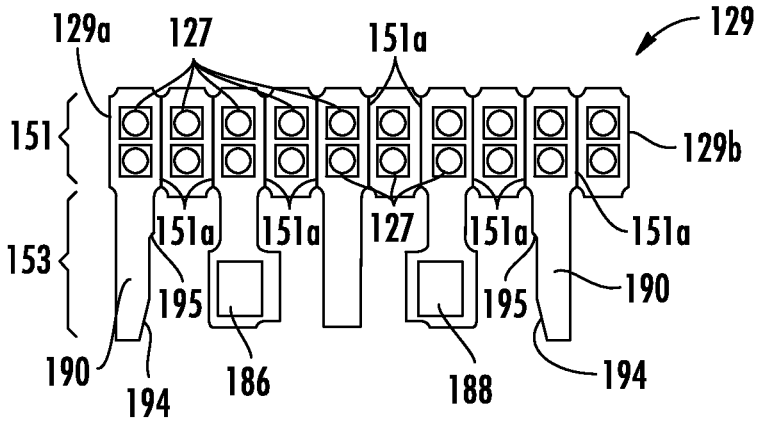
FIG. 9 is a side view of an embodiment of a MCPCB submount usable in embodiments of the lamp of the invention.
Figure 10:
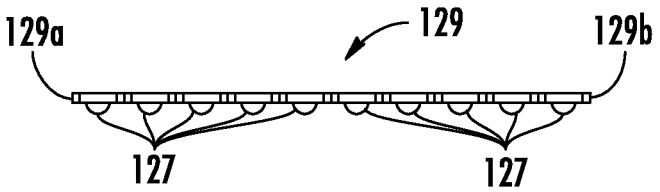
FIG. 10 is an end view of the embodiment of a MCPCB submount of FIG. 9.
Figure 11:
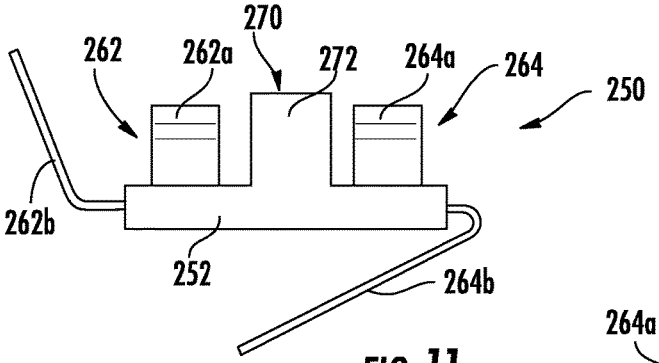
FIG. 11 is a plan view of the base electrical interconnect of the invention.
Figure 13:
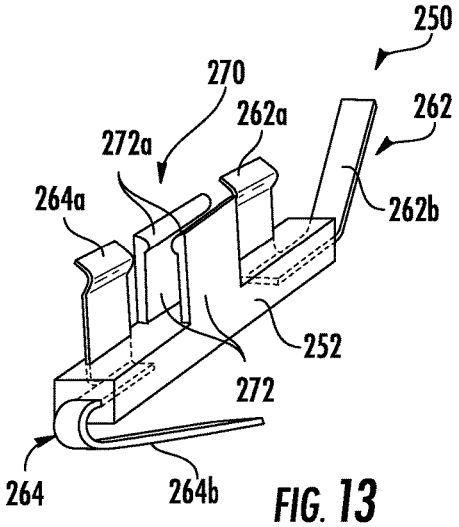
FIG. 13 is a perspective view of the base electrical interconnect of FIG. 11.
Figure 12:
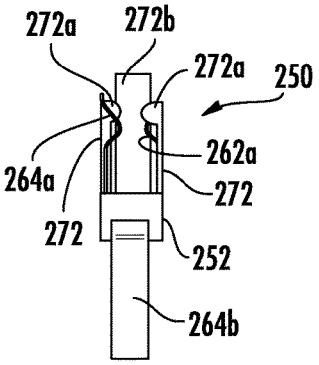
FIG. 12 is an end view of the base electrical interconnect of FIG. 11.

Referring to FIGS. 8, 9 and 10, in some embodiments, the submount 129 may be made of or comprise a thermally conductive material. The submount 129 may comprise a first LED mounting portion 151 that functions to mechanically support and electrically couple the LEDs 127 to the electrical path and a second connector portion 153 that functions to provide thermal, electrical and/or mechanical connections to the LED assembly 130. Extensions 190 may be formed on the LED assembly that connect the LED assembly 130 to the heat sink 149 and that position and support the LEDs 127 in the proper position in the enclosure as will hereinafter be described.

In some embodiments of LED assembly 130 the submount 129 may comprise a metal core board such as a metal core printed circuit board (MCPCB) as shown, for example, in FIGS. 8, 9 and 10. The metal core board comprises a thermally and electrically conductive core made of aluminum or other similar pliable metal material. The core is covered by a dielectric material such as polyimide. Metal core boards allow traces to be formed therein. In one method, the submount 129 is formed as a flat member and is bent into a suitable shape such as a cylinder, sphere, polyhedra or the like.

In some embodiments the submount 129 of the LED assembly 130 may comprise a lead frame made of an electrically conductive material such as copper, copper alloy, aluminum, steel, gold, silver, alloys of such metals, thermally conductive plastic or the like. In another embodiment of the LED assembly 130 the submount 129 may comprise a hybrid of a metal core board and lead frame. The metal core board may form the LED mounting portion 151 on which the LED packages containing LEDs 127 are mounted where the back side of the metal core board may be mechanically coupled to a lead frame structure. The lead frame structure may form the connector portion 153. Both the lead frame and the metal core board may be bent into the various configurations as discussed herein.

The LED assembly may also comprise a PCB made with FR4, which may comprise thermal vias, where the thermal vias may then be connected to the lead frame structure. The LED assembly may also comprise a PCB FR4 without a lead frame structure. A PCB FR4 board comprises a thin layer of copper foil laminated to one side, or both sides, of an FR4 glass epoxy panel. The FR4 copper-clad sheets comprise circuitry etched into copper layers to make the PCB FR4 board.

In another embodiment of LED assembly 130 the submount 129 may comprise a flex circuit. A flex circuit may comprise a flexible layer of a dielectric material such as a polyimide, polyester or other material to which a layer of copper or other electrically conductive material is applied such as by adhesive. Electrical traces are formed in the copper layer to form electrical pads for mounting the electrical components such as LEDs 127 on the flex circuit and for creating the electrical path between the components.

The submount 129 may be bent or folded or otherwise formed such that the LEDs 127 provide the desired light pattern in lamp 100. The angles of the LEDs and the number of LEDs may be varied to create a desired light pattern. In the illustrated embodiments the submount 129 is formed to have a generally cylindrical shape; however, the submount may have other shapes. The LED assembly 130 may be advantageously formed into any suitable three-dimensional shape. A "three-dimensional" LED assembly as used herein means an LED assembly where the submount comprises mounting surfaces for different ones of the LEDs that are in different planes such that the LEDs mounted on those mounting surfaces are also oriented in different planes. In some embodiments the planes are arranged such that the LEDs are disposed over a 360 degree range.

Lamp 100 may be used as an A-series lamp with an Edison base 102, more particularly; lamp 100 may be designed to serve as a solid-state replacement for an A19 incandescent bulb. In one embodiment, the enclosure and base are dimensioned to be a replacement for an ANSI standard A19 bulb such that the dimensions of the lamp 100 fall within the ANSI standards for an A19 bulb. The dimensions may be different for other ANSI standards including, but not limited to, A21 and A23 standards. While specific reference has been made with respect to an A-series lamp with an Edison base 102 the lamp may be embodied in other lamps such as directional lamps such as a replacement for a PAR-style incandescent bulb or a BR-style incandescent bulb. In other embodiments, the LED lamp can have any shape, including standard and non-standard shapes. While embodiments of a lamp 100 are shown and described herein in detail it is to be understood that the base electrical interconnect of the invention may be used in a wide variety of lamps and that the lamp 100 as described herein is for explanatory purposes.

The LED assembly 130 may be contained in an optically transmissive enclosure 112 through which light emitted by the LEDs 127 is transmitted to the exterior of the lamp. In the embodiment of FIGS. 1-5, for example, the enclosure 112 may be entirely optically transmissive where the entire enclosure 112 defines the exit surface through which light is emitted from the lamp. The enclosure 112 may have a traditional bulb shape having a globe shaped main portion 114 that narrows to a neck 115. The enclosure 112 may be made of glass, quartz, borosilicate, silicate, polycarbonate, other plastic or other suitable material. In some embodiments, the exit surface of the enclosure may be coated on the inside with silica, providing a diffuse scattering layer that produces a more uniform far field pattern. The enclosure may also be etched, frosted or coated to provide the diffuser. In other embodiments the enclosure may be made of a material such as polycarbonate where the diffuser is created by the polycarbonate material. Alternatively, the surface treatment may be omitted and a clear enclosure may be provided. The enclosure may also be provided with a shatter proof or shatter resistant coating. It should also be noted that in this or any of the embodiments shown here, the optically transmissive enclosure or a portion of the optically transmissive enclosure could be coated or impregnated with phosphor or a diffuser. The enclosure may also be of similar shape to that commonly used in directional bulbs such as standard BR and/or PAR incandescent bulbs or to A series bulbs. In a directional lamp the enclosure may be only partially optically transmissive where the enclosure comprises an optically transmissive exit surface through which light is emitted from the lamp and a reflective surface that reflects a portion of the light to the exit surface such that the emitted light may have a desired directional pattern.

The submount may comprise a series of anodes and cathodes arranged in pairs for connection to the LEDs 127. In the illustrated embodiment 20 pairs of anodes and cathodes are shown for an LED assembly having 20 LEDs 127; however, a greater or fewer number of anode/cathode pairs and LEDs may be used. Moreover, more than one submount may be used to make a single LED assembly 130. Electrical connectors or conductors such as traces connect the anode from one pair to the cathode of the adjacent pair to provide the electrical path between the anode/cathode pairs during operation of the LED assembly 130. An LED or LED package containing at least one LED 127 is secured to each anode and cathode pair where the LED/LED package spans the anode and cathode. The LEDs/LED packages may be attached to the submount by soldering. In one embodiment, the exposed surfaces of the submount 129 may be coated with silver, white plastic or other reflective material to reflect light inside of enclosure 112 during operation of the lamp. The submount 129 may have a variety of shapes, sizes and configurations.

LEDs and/or LED packages used with an embodiment of the invention and can include light emitting diode chips that emit hues of light that, when mixed, are perceived in combination as white light. Phosphors can be used as described to add yet other colors of light by wavelength conversion. For example, blue or violet LEDs can be used in the LED assembly of the lamp and the appropriate phosphor can be in any of the ways mentioned above. LED devices can be used with phosphorized coatings packaged locally with the LEDs or with a phosphor coating the LED die as previously described. For example, blue-shifted yellow (BSY) LED devices, which typically include a local phosphor, can be used with a red phosphor on or in the optically transmissive enclosure or inner envelope to create substantially white light, or combined with red emitting LED devices in the array to create substantially white light.

A lighting system using the combination of BSY and red LED devices referred to above to make substantially white light can be referred to as a BSY plus red or "BSY+R" system. In such a system, the LED devices used include LEDs operable to emit light of two different colors. A further detailed example of using groups of LEDs emitting light of different wavelengths to produce substantially while light can be found in issued U.S. Pat. No. 7,213,940, which is incorporated herein by reference in its entirety.

Referring again to the figures, the LED assembly 130 may be mounted to a heat sink structure 149 by an electrical interconnect 150 that provides the electrical connection between the LED assembly 130 and the lamp electronics 110. The heat sink structure 149 comprises a heat conducting portion or tower 152 and a heat dissipating portion 154 as shown for example in FIGS. 1-5. In one embodiment the heat sink 149 is made as a one-piece member of a thermally conductive material such as aluminum, zinc or the like. The heat sink structure 149 may also be made of multiple components secured together to form the heat structure. Moreover, the heat sink 149 may be made of any thermally conductive material or combinations of thermally conductive materials. In some embodiments a heat sink structure may not be used.

The heat conducting portion 152 may be formed as a tower that is dimensioned and configured to make good thermal contact with the LED assembly 130 such that heat generated by the LED assembly 130 may be efficiently transferred to the heat sink 149. In one embodiment, the heat conducting portion 152 comprises a tower that extends along the longitudinal axis of the lamp and extends into the center of the enclosure 112. The heat conducting portion 152 may comprise generally cylindrical outer surface that matches the generally cylindrical internal surface of the LED assembly 130. The heat dissipating portion 154 is in good thermal contact with the heat conducting portion 152 such that heat conducted away from the LED assembly 130 by the heat conducting portion 152 may be efficiently dissipated from the lamp 100 by the heat dissipating portion 154. The heat dissipating portion 154 extends from the interior of the enclosure 112 to the exterior of the lamp 100 such that heat may be dissipated from the lamp to the ambient environment. A plurality of heat dissipating members 158 may be formed on the exposed portion to facilitate the heat transfer to the ambient environment. In one embodiment, the heat dissipating members 158 comprise a plurality fins that extend outwardly to increase the surface area of the heat dissipating portion 154. The heat dissipating portion 154 and fins 158 may have any suitable shape and configuration.

Figure 6:
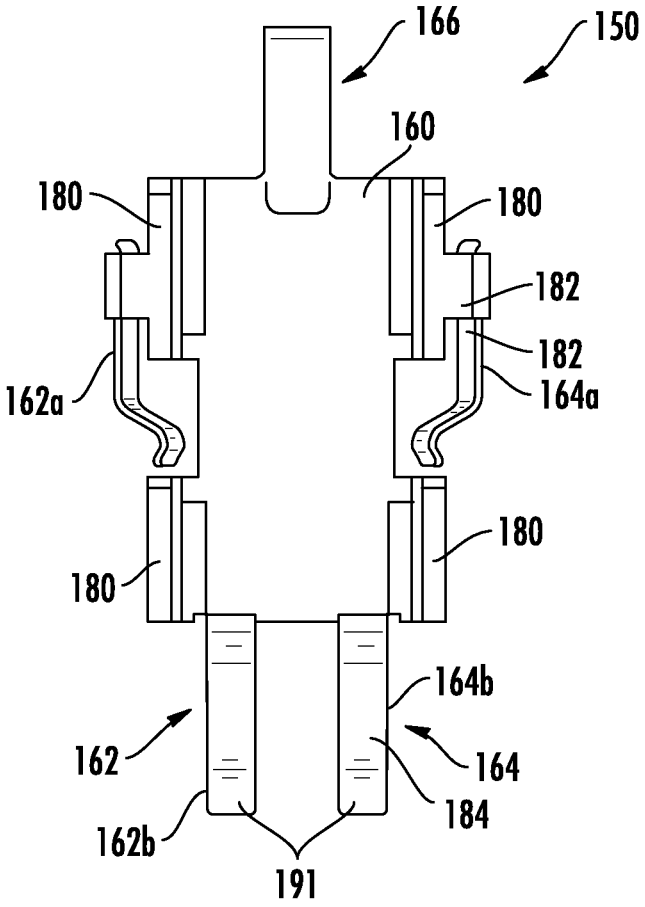
FIG. 6 is a plan view showing an embodiment of an electrical interconnect used in the lamp of FIG. 1.
Figure 7:
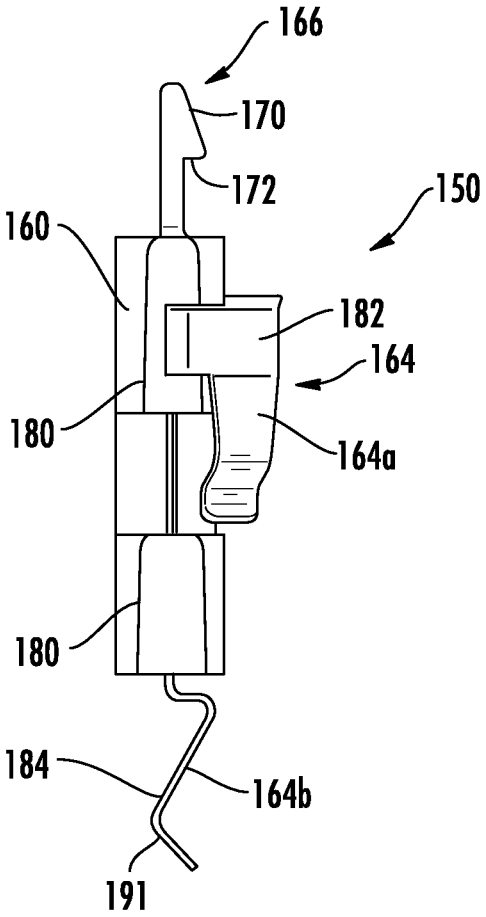
FIG. 7 is a side view of the electrical interconnect of FIG. 6.

The electrical interconnect 150 comprises electrical conductors that form part of the electrical path connecting the LED assembly 130 to the lamp electronics 110 and is shown in greater detail in FIGS. 6 and 7. The interconnect 150 provides an electrical connection between the LED assembly 130 and the lamp electronics 110 that does not require bonding of the contacts from the lamp electronics 110 to the LED assembly 130.

As shown in the figures, the electrical interconnect 150 comprises a body 160 that includes a first conductor 162 for connecting to one of the anode or cathode side of the LED assembly 130 and a second conductor 164 for connecting to the other one of the anode or cathode side of the LED assembly 130. The first conductor 162 extends through the body 160 to form an LED-side contact **162*a* and a lamp electronics-side contact 162*b*. The second conductor 164 extends through the body 160 to form an LED-side contact 164*a* and a lamp electronics-side contact 164*b*. The body 160 may be formed by insert molding the conductors 162, 164 in a plastic insulator body 160. While the electrical interconnect 150 may be made by insert molding the body 160, the electrical interconnect 150 may be constructed in a variety of manners. For example, the body 160 may be made of two body sections that are joined together to trap the conductors 162, 164 between the two body sections. Further, each conductor may be made of more than one component provided an electrical pathway is provided in the body 160**.

The electrical interconnect 150 may be inserted into the cavity 174 of the heat sink 149 from the bottom of the heat sink 149 and moved toward the opposite end of the heat sink such that the camming surface 170 of finger 166 contacts the fixed member 168. The engagement of the camming surface 170 with the fixed member 168 deforms the finger 166 to allow the lock member 172 to move past the fixed member 168. As the lock member 172 passes the fixed member 168 the finger 166 returns toward its undeformed state such that the lock member 172 is disposed behind the fixed member 168. The engagement of the lock member 172 with the fixed member 168 fixes the electrical interconnect 150 in position in the heat sink 149. The snap-fit connection allows the electrical interconnect 150 to be inserted into and fixed in the heat sink 149 in a simple insertion operation without the need for any additional connection mechanisms, tools or assembly steps. The tabs 180 are positioned in the slots 176, 178 such that as the electrical interconnect 150 is inserted into the heat sink 149, the tabs 180 engage the slots 176, 178 to guide the electrical interconnect 150 into the heat sink 149.

The first LED-side contact 162*a* and the second LED-side contact 164*a* are arranged such that the contacts extend through the first and second slots 176, 178, respectively, as the electrical interconnect 150 is inserted into the heat sink 149. The contacts 162*a*, 164*a* are exposed on the outside of the heat conducting portion 152. The contacts 162*a*, 164*a* are arranged such that they create an electrical connection to the anode side and the cathode side of the LED assembly 130 when the LED assembly 130 is mounted on the heat sink 149. In the illustrated embodiment the contacts are identical such that specific reference will be made to contact 164*a*. The contact 164*a* comprises a laterally extending portion 182 that extends from the body 160 and that extends through the slot 178. The laterally extending portion 182 connects to a spring portion 182 that is arranged such that it extends over the heat conducting portion 152 and abuts or is in close proximity to the outer surface of the heat conducting portion 152. The contact 164*a* is resilient such that it can be deformed to ensure a good electrical contact with the LED assembly 130.

Figure 14:
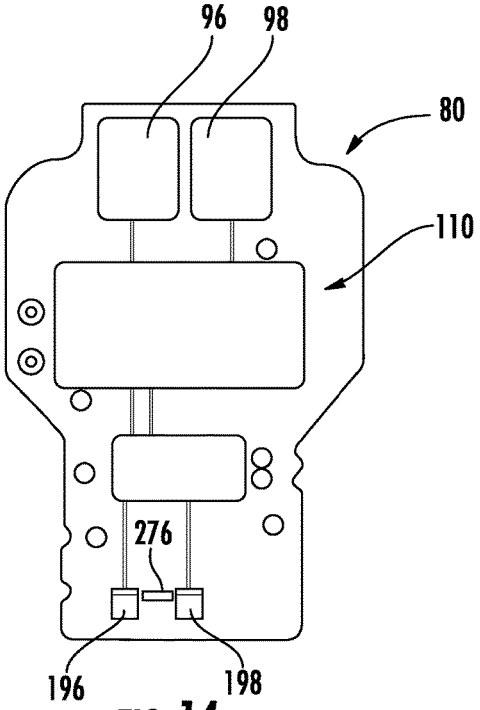
FIG. 14 is a plan view of an embodiment of the electronics board of the invention.
Figure 15:
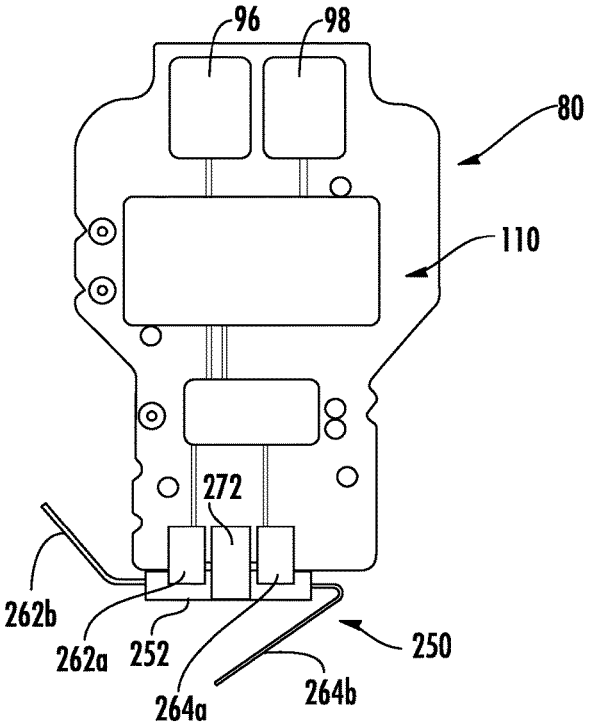
FIG. 15 is a plan view of the base electrical interconnect of FIGS. 11-13 attached to the electronics board of FIG. 14.
Figure 16:
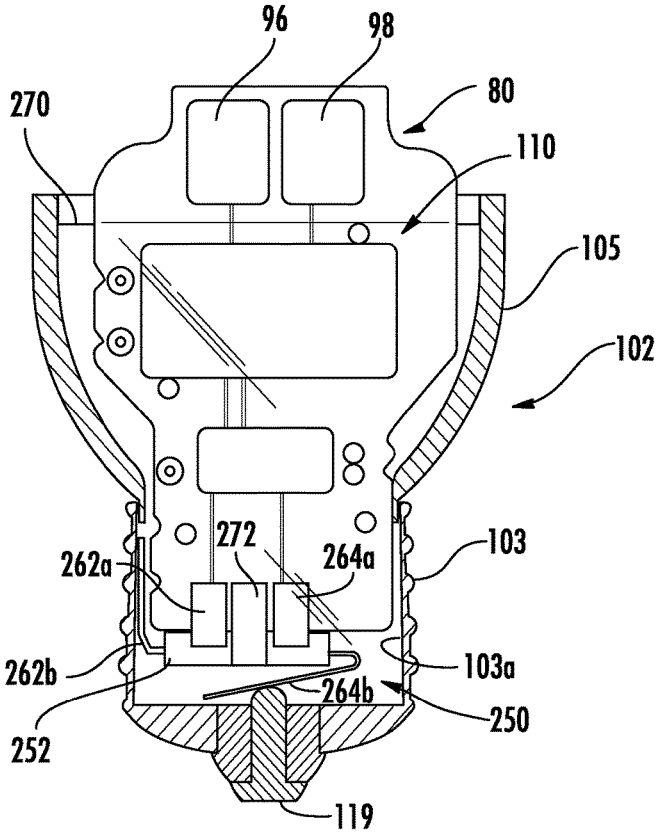
FIG. 16 is a partial section view showing the electronics board of the invention and base electrical interconnect mounted in a lamp base.

The first electronic-side contact 162*b* and the second electronic-side contact 164*b* are arranged such that the contacts 162*b*, 164*b* extend beyond the bottom of the heat sink 149 when the electrical interconnect 150 is inserted into the heat sink 149. The contacts 162*b*, 164*b* are arranged such that they create an electrical connection to the anode side and the cathode side of the lamp electronics 110. In the illustrated embodiment the contacts 162*b*, 164*b* are identical such that specific reference will be made to contact 164*b*. The contact 164*b* comprises a spring portion 184 that is arranged such that it extends generally away from the electrical interconnect 150. The contact 164*b* is resilient such that it can be deformed to ensure a good electrical contact with the lamp electronics 110. The lamp electronics 110 include a first contact pad 96 and a second contact pad 98 (FIGS. 5 and 14) that are contacted by the contacts 162*b*, 164*b* to provide the electrical coupling between the lamp electronics 110 and the LED assembly 130 in the lamp. Contact pads 96 and 98 may be formed on electronics board 80 and may be electrically coupled to the power supply, including, for example, large capacitor and EMI components that are across the input AC line, along with the driver circuitry as described herein.

The LED assembly 130 comprises an anode side contact 186 and a cathode side contact 188. The contacts 186, 188 may be formed as part of the conductive submount 129 on which the LEDs are mounted. The contacts 186, 188 are electrically coupled to the LEDs 127 such that they form part of the electrical path between the lamp electronics 110 and the LED assembly 130. The contacts 186, 188 extend from the LED mounting portion 151 such that when the LED assembly 130 is mounted on the heat sink 149 the contacts 186, 188 are disposed between the LED-side contacts 162*a*, 164*a*, respectively, and the heat sink 149. The LED-side contacts 162*a*, 164*a* are arranged such that as the contacts 186, 188 are inserted behind the LED-side contacts 162*a*, 164*a*, the LED-side contacts 162*a*, 164*a* are slightly deformed. Because the LED-side contacts 162*a*, 164*a* are resilient, a bias force is created that biases the LED-side contacts 162*a*, 164*a* into engagement with the LED assembly 130 contacts 186, 188 to ensure a good electrical coupling between the LED-side contacts 162*a*, 164*a* and the LED assembly 130. The engagement between biased contacts of the electrical interconnect 150 and the and the anode side contacts and the cathode side contacts of the LED assembly 130 and electronics board 80 is referred to herein as a contact coupling where the electrical coupling is created by the pressure contact between the contacts as distinguished from a soldered coupling.

To position the LED assembly 130 relative to the heat sink and to fix the LED assembly 130 to the heat sink, a pair of extensions 190 may be provided on the LED assembly 130 that engage mating receptacles 192 formed on the heat sink. In one embodiment the extensions 190 comprise portions of the submount 129 that extend away from the LED mounting area 151 of the LED assembly 130. The extensions 190 extend toward the bottom of the heat sink 149 along the direction of insertion of the LED assembly 130 onto the heat sink. The heat sink 149 is formed with mating receptacles 192 that are dimensioned and arranged such that one of the extensions 190 is inserted into each of the receptacles 192 when the heat sink 149 is inserted into the LED assembly 130. The engagement of the extensions 190 and the receptacles 192 properly positions the LED assembly 130 relative to the heat sink during assembly of the lamp.

To fix the LED assembly 130 on the heat sink 149 and to seat the LED assembly 130 against the heat conducting portion 152 to ensure good thermal conductivity between these elements, the extensions 190 are formed with camming surfaces 194 that engage the receptacles 192 and clamp the LED assembly 130 on the heat sink 149. The engagement of the extensions 190 with the receptacles 192 is used to hold the LED assembly 130 in the desired shape and to clamp the LED assembly 130 on the heat sink. As shown in FIGS. 8 and 9 a surface of each of the extensions 190 is formed with a camming surface 194 where the camming surface 194 is created by arranging the surface 194 an angle relative to the insertion direction of the LED assembly 130 on the heat sink 149, or as a stepped surface, or as a curved surface or as a combination of such surfaces. As a result, as each extension 190 is inserted into the corresponding receptacle 192 the wall of the receptacle 192 engages the camming surface 194 and, due to the angle or shape of the camming surface 194, exerts a force on the LED assembly 130 tending to move one free end 129*a* of the LED assembly 130 toward the opposite free end 129*b* of the LED assembly 130. The extensions 190 are formed at or near the free ends of the LED assembly 130 and the camming surfaces 194 are arranged such that the free ends 129*a*, 129*b* of the LED assembly 130 are moved in opposite directions toward one another. As the free ends of the LED assembly 130 are moved toward one another, the inner circumference of the LED assembly 130 is gradually reduced such that the LED assembly 130 exerts an increasing clamping force on the heat conducting portion 152 as the LED assembly 130 is inserted on the heat sink 149. The camming surfaces 194 are arranged such that when the LED assembly 130 is completely seated on the heat sink 149 the LED assembly 130 exerts a tight clamping force on the heat conducting portion 152. The clamping force holds the LED assembly 130 on the heat sink 149 and ensures a tight surface-to-surface engagement between the LED assembly 130 and the heat sink 149 such that heat generated by the LED assembly 130 is efficiently transferred to the heat sink 149. The LED submount 129 is under radial tension on the heat sink 149.

When the electrical interconnect 150 is mounted to the heat sink 149 and the LED assembly 130 is mounted on the heat sink 149, an electrical path is created between the electronics-side contacts 162*a*, 164*a* of the electrical interconnect 150 and the LED assembly 130 and between the lamp electronics-side contacts 162*b*, 164*b* and he pads 96, 98. These components are physically and electrically connected to one another and the electrical path is created without using any additional fasteners, connection devices, tools or additional assembly steps.

The base 102 may comprise an electrically conductive Edison screw 103 for connecting to an Edison socket and a housing portion 105 connected to the Edison screw 103. The Edison screw 103 may be connected to the housing portion 105 by adhesive, mechanical connector, welding, separate fasteners or the like. The housing portion 105 and the Edison screw 103 define an internal cavity for receiving the lamp electronics 110 including the power supply and/or drivers or a portion of the electronics for the lamp. The lamp electronics 110 are electrically coupled to the Edison screw 103 such that the electrical connection may be made from the Edison screw 103 to the lamp electronics 110. The base 102 may be potted to physically and electrically isolate and protect the lamp electronics 110.

In some embodiments, a driver and/or power supply may be included with the LED array 128 on the submount 129. In other embodiments the lamp electronics 110 such as the driver and/or power supply are mounted on electronics board 80 and may be located at least partially in the base 102 as shown. The power supply and drivers may also be mounted separately where components of the power supply are mounted in the base 102 and the driver is mounted with the submount 129 in the enclosure 112. Base 102 may include a power supply or driver and form all or a portion of the electrical path between the mains and the LEDs 127. The base 102 may also include only part of the power supply circuitry while some smaller components reside on the submount 129. Suitable power supplies and drivers are described in U.S. patent application Ser. No. 13/462,388 filed on May 2, 2012 and titled "Driver Circuits for Dimmable Solid State Lighting Apparatus" which is incorporated herein by reference in its entirety; U.S. patent application Ser. No. 12/775,842 filed on May 7, 2010 and titled "AC Driven Solid State Lighting Apparatus with LED String Including Switched Segments" which is incorporated herein by reference in its entirety; U.S. patent application Ser. No. 13/192,755 filed Jul. 28, 2011 titled "Solid State Lighting Apparatus and Methods of Using Integrated Driver Circuitry" which is incorporated herein by reference in its entirety; U.S. patent application Ser. No. 13/339,974 filed Dec. 29, 2011 titled "Solid-State Lighting Apparatus and Methods Using Parallel-Connected Segment Bypass Circuits" which is incorporated herein by reference in its entirety; U.S. patent application Ser. No. 13/235,103 filed Sep. 16, 2011 titled "Solid-State Lighting Apparatus and Methods Using Energy Storage" which is incorporated herein by reference in its entirety; U.S. patent application Ser. No. 13/360,145 filed Jan. 27, 2012 titled "Solid State Lighting Apparatus and Methods of Forming" which is incorporated herein by reference in its entirety; U.S. patent application Ser. No. 13/338,095 filed Dec. 27, 2011 titled "Solid-State Lighting Apparatus Including an Energy Storage Module for Applying Power to a Light Source Element During Low Power Intervals and Methods of Operating the Same" which is incorporated herein by reference in its entirety; U.S. patent application Ser. No. 13/338,076 filed Dec. 27, 2011 titled "Solid-State Lighting Apparatus Including Current Diversion Controlled by Lighting Device Bias States and Current Limiting Using a Passive Electrical Component" which is incorporated herein by reference in its entirety; and U.S. patent application Ser. No. 13/405,891 filed Feb. 27, 2012 titled "Solid-State Lighting Apparatus and Methods Using Energy Storage" which is incorporated herein by reference in its entirety.

The AC to DC conversion may be provided by a boost topology to minimize losses and therefore maximize conversion efficiency. The boost supply is connected to high voltage LEDs operating at greater than 200V. Other embodiments are possible using different driver configurations, or a boost supply at lower voltages.

The lamp electronics 110 are mounted on a printed circuit board (PCB), printed wiring board (PWB), metal core printed circuit board (MCPCB), FR-4 board, or other substrate on which the lamp electronics may be mounted and which may include the electrical conductors for delivering current from the base 102 to the lamp electronics 110 (collectively referred to as "electronics board"). The electrical conductors may be formed as traces on the electronics board, a separate metal layer or other electrical conductor formed as part of the board or applied to the board for delivering current from the base to the lamp electronics. The electronics board 80 may be at least partially located in the base 102 and a portion of the electronics board may be located in the interior space defined by the Edison screw 103. Typically, the electronics board 80 extends into the Edison screw 103 and may extend partially out of the Edison screw where it may be contained in a housing 105 and/or in the enclosure 112. The electronics board 80 typically supports the electrical components of the lamp 110 including the power supply, driver and/or other lamp electronics.

Referring to FIGS. 11-16, to facilitate the mounting of the electronics board 80 to the base 102 and to create the electrical connection between the electronics board 80 and the base 102, the electronics board 80 is formed with a second set of electrical contact pads 196, 198 that form part of the electrical path to the LEDs 127 and are electrically coupled to the lamp electronics 110 on electronics board 80. In one embodiment the pads 196, 198 are formed as part of the electrical connections on the electronics board 80. The pads 196, 198 may be formed, for example, as part of the traces on the electronics board 80 or the pads 196, 198 may be formed as separate electrical conductors that are electrically connected to the electrical components on the electronics board 80. In one embodiment the pads 196, 198 are formed adjacent the lower edge of the electronics board 80 near the end of the Edison screw 103; however, the pads 196, 198 may be formed in any suitable location on the electronics board 80.

In one embodiment a separate base electrical interconnect 250 is provided for electrically coupling the electronics board 80 to the Edison screw 103. The base electrical interconnect 250 comprises an electrically insulating body 252 that supports a first conductor 262 for connecting to one of the anode or cathode side of the electronics board and a second conductor 264 for connecting to the other one of the anode or cathode side of the electronics board. The first conductor 262 may extend through the body 252 to form a board-side contact 262*a* and a screw-side contact 262*b*. The second conductor 264 may extend through the body 252 to form a board-side contact 264*a* and a screw-side contact 264*b*. The base electrical interconnect 250 may be formed by insert molding the conductors 262, 264 in a plastic insulator body 252. While the base electrical interconnect 250 may be made by insert molding the body 252, the electrical interconnect 250 may be constructed in a variety of manners. For example, the body 252 may be made of two sections that are joined together to trap the conductors 262, 264 between the two body sections. Further, each conductor 262, 264 may be made of more than one component provided an electrical pathway is provided in the body 252.

The body 252 comprises a board engagement member such as clip 270 that may comprise a plurality of deformable resilient members 272 that engage the electronics board 80. In one embodiment the members 272 are opposed to one another such that the electronics board 80 may be trapped between and gripped by the members 272. The base electrical interconnect 250 may be mounted on the electronics board by deforming the members 272 to engage the electronics board 80. The deformable members 272 may comprise protrusions 272*a* that engage mating recesses 276 formed on the electronics board 80 such that a mechanical engagement is created between the members 272 and the electronics board 80. To mount the base electrical interconnect 250 on the electronics board 80, the edge of the electronics board 80 is inserted between the resilient members 272 such that the members are deformed or deflected away from one another. The resiliency of the material of the members 272 creates a bias force applied by the members to the electronics board 80 sufficient to retain the base electrical interconnect 250 on the electronics board 80. Where a protrusion 272*a* is provided on the members 272 that mate with the recesses 276 on the electronics board the electrical interconnect is also mechanically attached to the electronics board. The snap-fit connection between the electrical interconnect 250 and the electronics board 80 allows the electrical interconnect 250 to be fixed to the electronics board 80 in a simple operation without the need for any additional connection mechanisms, tools or assembly steps. While one embodiment of the snap-fit connection is shown, numerous changes may be made. For example, the protrusions may be formed on the electronics board that engage recesses on the members 272. Moreover, the deformable resilient members may be formed on the electronics board 80 that engage the body 252 of the base electrical interconnect 250. Further, the bias force of the members 272 against the electronics board may be created by separate biasing mechanisms such as springs in place of or in addition to the force generated by the deformation of the members 272. Further, rather than using a snap-fit connection, the electrical interconnect 250 may be fixed to the electronics board 80 using mechanisms other than a snap fit connection such as screws or other fasteners, adhesive or the like. Moreover, each conductor 262, 264 may be mounted on a separate body that is separately attached to the electronics board 80 rather than both conductors being mounted on the same body.

The first board-side contact 262*a* and the second board-side contact 264*a* are arranged such that the contacts create an electrical connection to the pads 196, 198 of the electronics board 80 when the base electrical interconnect 250 is mounted on the electronics board. The board-side contacts 262*a*, 264*a* are arranged such that when the electrical interconnect 250 is mounted on the electronics board 80, the board-side contacts 262*a*, 264*a* are slightly deformed and engage pads 196, 198. Because the board-side contacts 262*a*, 264*a* are resilient, a bias force is created that biases the board-side contacts 262*a*, 264*a* into engagement with the pads 196, 198 on the electronics board 80 to ensure a good electrical coupling between the board-side contacts 262*a*, 264*a* and the electronics board 80. The engagement between the board-side contacts 262*a*, 264*a* of the electrical interconnect 250 and the and the anode side contact and the cathode side contacts of the electronics board 80 is a contact coupling where the electrical coupling is created by the contact under pressure between the contacts 262*a*, 264*a* and the pads 196, 198 as distinguished from a soldered coupling and does not require separate wires or soldering.

The first base-side contact 262*b* and the second base-side contact 264*b* are arranged such that the contacts 262*b*, 264*b* extend from the electronics board 80 when the electrical interconnect 250 is mounted on the electronics board. The contacts 262*b*, 264*b* are configured such that they create an electrical connection to the anode side and the cathode side of the base 102. Where an Edison screw 103 is used one base-side contact creates a contact coupling with the inside wall 103*a* of the screw 103 and the other base-side contact creates a contact coupling with the centerline contact 119. The contacts 262*b*, 264*b* are resilient such that the contacts are deformed when the electronics board 80 and the base electrical interconnect 250 are inserted into the screw 103 to ensure a good electrical contact with the base. The engagement between the base-side contacts 262*b*, 264*b* of the base electrical interconnect 250 and the and the contacts of the Edison screw 103 80 is a contact coupling where the electrical coupling is created by the contact under pressure between the contacts 262*b*, 264*b* and the Edison screw 103 as distinguished from a soldered coupling and does not require separate wires or soldering.

Figure 17:
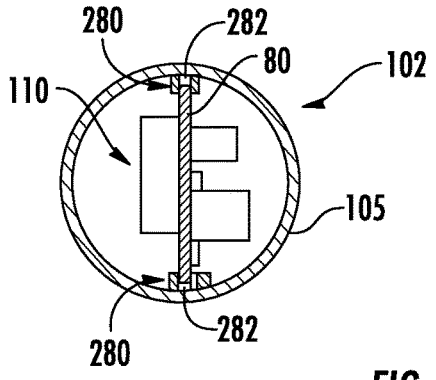
FIGS. 17 through 20 are horizontal section views through the housing showing various embodiments of attachment mechanisms for the electronics board.
Figure 18:
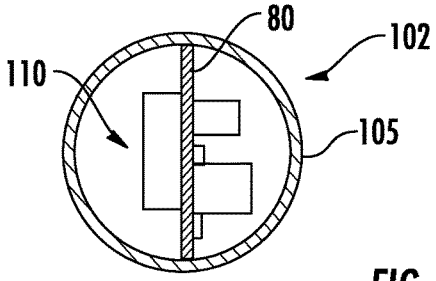
Figure 19:
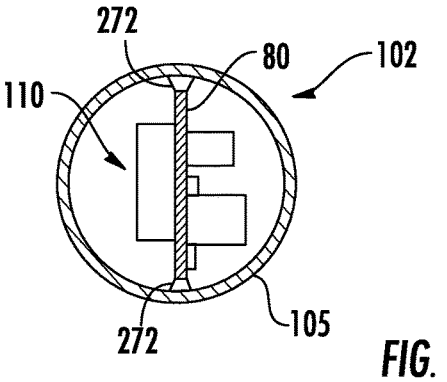
Figure 20:
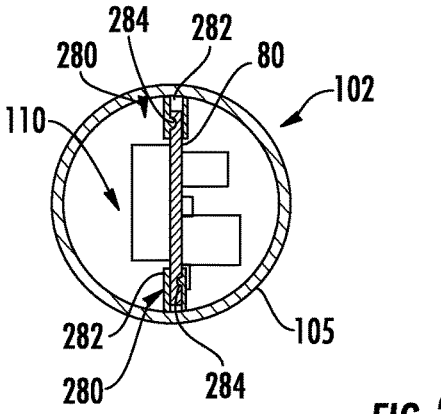

To mount the electronics board in the base, the base electrical interconnect 250 is mounted onto the electronics board 80 to create an electrical contact coupling between the board-side contacts 262*a*, 264*a* of the electrical interconnect 250 and the pads 196, 198 on the electronics board 80. The electronics board, with the base electrical interconnect 250, is inserted into the base 102 such that the base electrical interconnect 250 is positioned in the Edison screw 103. The base-side contacts 262*b*, 264*b* are deformed as the electronics board is inserted into the screw 103. Specifically, as the electronics board 80 is inserted into the screw 103 the first base-side contact 262*b* is deformed by and creates an electrical contact coupling with the interior surface 103*a* of the wall of the screw 103. The electronics board 80 is inserted until the second base-side contact 264*b* contacts and is deformed by the centerline contact 119 of the screw 103. The physical contact between contact 262*b* and wall 103*a* and the physical contact between contact 264*b* and centerline contact 119 creates electrical contact couplings. The bias force created by the deformation of the contacts 262*b* and 264*b* with the screw 103 ensures a good electrical connection between the base electrical interconnect 250 and the screw 103 without requiring soldering or wires. Because the centerline contact 119 is disposed along the axis of the screw 103 and the wall 103*a* of the screw 103 surrounds the electronics board 80, the electronics board may be inserted into the base 102 in any angular orientation provided that the electronics board is generally centered in the base. However, if desired guides 280 may be formed in the base 102 to properly orient the electronics board 80 relative to the base as shown in FIG. 17. For example guides 280 may comprise channels 282 molded or otherwise formed along the walls of the housing 105 and/or may be formed on the interior wall of the screw 103. Once the PCB is properly located in the base 102 it may be held in position by a potting material 270 such as silicone (FIG. 16), adhesive 272 (FIG. 19), mechanical fasteners such as screws or the like. Further, the electronics board 80 may be configured such that it engages the internal wall of the housing 105 to create a tight friction fit between the electronics board 80 and the base 102 as shown in FIG. 18. In other embodiments the base may comprise engagements members such as channels 282 that receive the electronics board 80. The channels 282 may tightly engage the electronics board to create a friction fit and/or the channels may comprise engagement members 284 such as protrusions on the channels that engage mating recesses on the electronics board to mechanically lock the PCB to the base (FIG. 20). Referring to FIGS. 11-16, to facilitate the mounting of the electronics board 80 to the base 102 and to create the electrical connection between the electronics board 80 and the base 102, the electronics board 80 is formed with a second set of electrical contact pads 196, 198 that form part of the electrical path to the LEDs 127 and are electrically coupled to the lamp electronics 110 on electronics board 80. In one embodiment the pads 196, 198 are formed as part of the electrical connections on the electronics board 80. The pads 196, 198 may be formed, for example, as part of the traces on the electronics board 80 or the pads 196, 198 may be formed as separate electrical conductors that are electrically connected to the electrical components on the electronics board 80. In one embodiment the pads 196, 198 are formed adjacent the lower edge of the electronics board 80 near the end of the Edison screw 103; however, the pads 196, 198 may be formed in any suitable location on the electronics board 80.

Figure 22:
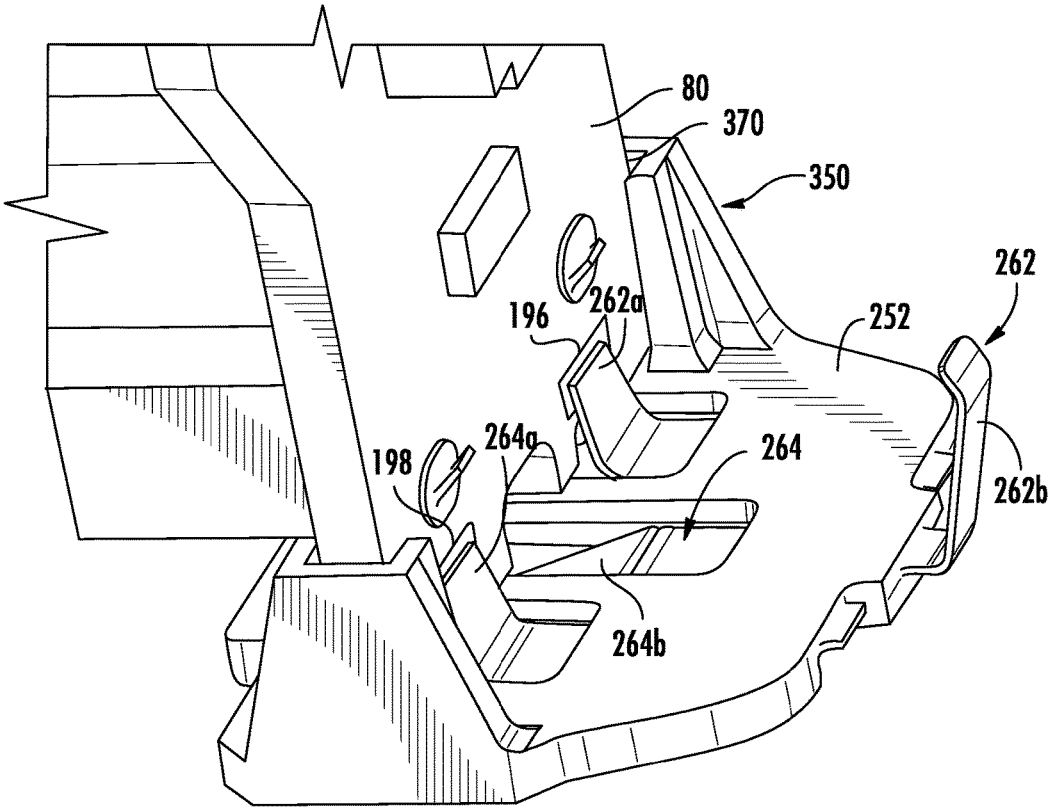
FIG. 22 is a perspective view of another embodiment of the base electrical interconnect of the invention mounted on an electronics board.
Figure 23:
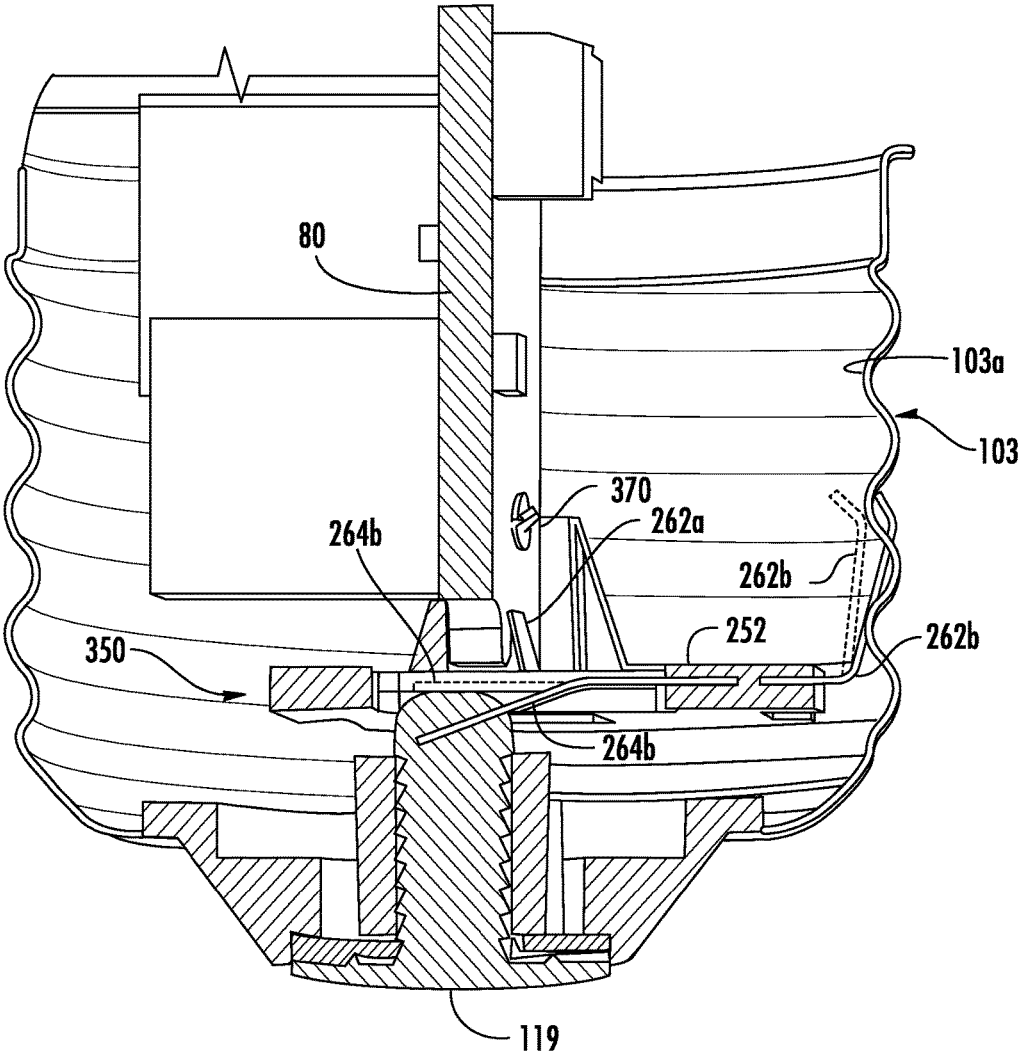
FIG. 23 is another view of the base electrical interconnect of FIG. 22 mounted on a board in a lamp base.

An alternate embodiment of a base electrical interconnect 350 is provided for electrically coupling the electronics board 80 to the Edison screw 103 is shown in FIGS. 22 and 23. Like reference numerals are used in the figures to identify similar components as previously described. The base electrical interconnect 350 comprises an electrically insulating body 252 that supports a first conductor 262 for connecting to one of the anode or cathode side of the electronics board and a second conductor 264 for connecting to the other one of the anode or cathode side of the electronics board. The first conductor 262 may extend through the body 252 to form a board-side contact 262*a* and a screw-side contact 262*b*. The second conductor 264 may extend through the body 252 to form a board-side contact 264*a* and a screw-side contact 264*b*. The base electrical interconnect 350 may be formed by insert molding the conductors 262, 264 in a plastic insulator body 252. While the base electrical interconnect 350 may be made by insert molding the body 252, the base electrical interconnect 350 may be constructed in a variety of manners. For example, the body 252 may be made of two sections that are joined together to trap the conductors 262, 264 between the two body sections. Further, each conductor 262, 264 may be made of more than one component provided an electrical pathway is provided in the body 252.

The body 252 comprises a board engagement member such as channel 370 that receives an edge of the electronics board 80. In one embodiment the channel 370 is dimensioned such that the electronics board 80 may be retained in the channel such as by a friction fit. The base electrical interconnect 350 may be mounted on the electronics board by inserting the electronics board 80 into the channel 370. Deformable members such as protrusions may be formed in the channel 370 that engage mating recesses formed on the electronics board 80 such that a mechanical engagement is created between the base electrical interconnect 350 and the electronics board 80 as previously described. The body 252 may be made of resilient material such as plastic such that the channel is deformed slightly to create a bias force on the electronics board 80 sufficient to retain the base electrical interconnect 350 on the electronics board 80. The friction-fit connection between the base electrical interconnect 350 and the electronics board 80 allows the electrical interconnect 350 to be fixed to the electronics board 80 in a simple operation without the need for any additional connection mechanisms, tools or assembly steps. While one embodiment of the friction-fit connection is shown, numerous changes may be made. Further, rather than using a friction-fit connection, the base electrical interconnect 350 may be fixed to the electronics board 80 using mechanisms other than a friction-fit connection such as screws or other fasteners, adhesive or the like. Moreover, each conductor 262, 264 may be mounted on a separate body that is separately attached to the electronics board 80 rather than both conductors being mounted on the same body.

The first board-side contact 262*a* and the second board-side contact 264*a* are arranged such that the contacts create an electrical connection to the pads 196, 198 of the electronics board 80 when the electrical interconnect 250 is mounted on the electronics board. The board-side contacts 262*a*, 264*a* are arranged such that when the base electrical interconnect 350 is mounted on the electronics board 80, the board-side contacts 262*a*, 264*a* are slightly deformed and engage pads 196, 198. Because the board-side contacts 262*a*, 264*a* are resilient, a bias force is created that biases the board-side contacts 262*a*, 264*a* into engagement with the pads 196, 198 on the electronics board 80 to ensure a good electrical coupling between the board-side contacts 262*a*, 264*a* and the electronics board 80. The engagement between the board-side contacts 262*a*, 264*a* of the base electrical interconnect 350 and the and the anode side contact and the cathode side contacts of the electronics board 80 is a contact coupling where the electrical coupling is created by the contact under pressure between the contacts 262*a*, 264*a* and the pads 196, 198 as distinguished from a soldered coupling and does not require separate wires or soldering.

The first base-side contact 262*b* and the second base-side contact 264*b* are arranged such that the contacts 262*b*, 264*b* extend from the base electrical interconnect 350 when the base electrical interconnect 350 is mounted on the electronics board. The contacts 262*b*, 264*b* are configured such that they create an electrical connection to the anode side and the cathode side of the base 102. Where an Edison screw 103 is used one base-side contact creates a contact coupling with the inside wall 103*a* of the screw 103 and the other base-side contact creates a contact coupling with the centerline contact 119. The contacts 262*b*, 264*b* are resilient such that the contacts are deformed when the electronics board 80 and the base electrical interconnect 350 are inserted into the screw 103 to ensure a good electrical contact with the base. The engagement between the base-side contacts 262*b*, 264*b* of the base electrical interconnect 350 and the and the contacts of the Edison screw 103 is a contact coupling where the electrical coupling is created by the contact under pressure between the contacts 262*b*, 264*b* and the Edison screw 103 as distinguished from a soldered coupling and does not require separate wires or soldering To mount the electronics board in the base, the base electrical interconnect 350 is mounted onto the electronics board 80 to create an electrical contact coupling between the board-side contacts 262*a*, 264*a* of the base electrical interconnect 350 and the pads 196, 198 on the electronics board 80. The electronics board, with the base electrical interconnect 350, is inserted into the base 102 such that the base electrical interconnect 350 is positioned in the Edison screw 103. The base-side contacts 262*b*, 264*b* are deformed as the electronics board is inserted into the screw 103. Specifically, as the electronics board 80 is inserted into the screw 103 the first base-side contact 262*b* is deformed by and creates an electrical contact coupling with the interior surface 103*a* of the wall of the screw 103. The first base-side contact 262*b* is deformed from the solid line position to the dashed line position of FIG. 23. The electronics board 80 is inserted until the second base-side contact 264*b* contacts and is deformed by the centerline contact 119 of the screw 103. The second base-side contact 264*b* is deformed from the solid line position to the dashed line position of FIG. 23. The physical contact between contact 262*b* and wall 103*a* and the physical contact between contact 264*b* and centerline contact 119 creates electrical contact couplings. The bias force created by the deformation of the contacts 262*b* and 264*b* with the screw 103 ensures a good electrical connection between the electrical interconnect 250 and the screw 103 without requiring soldering or wires. Because the centerline contact 119 is disposed along the axis of the screw 103 and the wall 103*a* of the screw 103 surrounds the electronics board 80, the electronics board may be inserted into the base 102 in any angular orientation provided that the electronics board is generally centered in the base. However, if desired guides 280 may be formed in the base 102 to properly orient the electronics board 80 relative to the base as previously shown and described.

Figure 21:
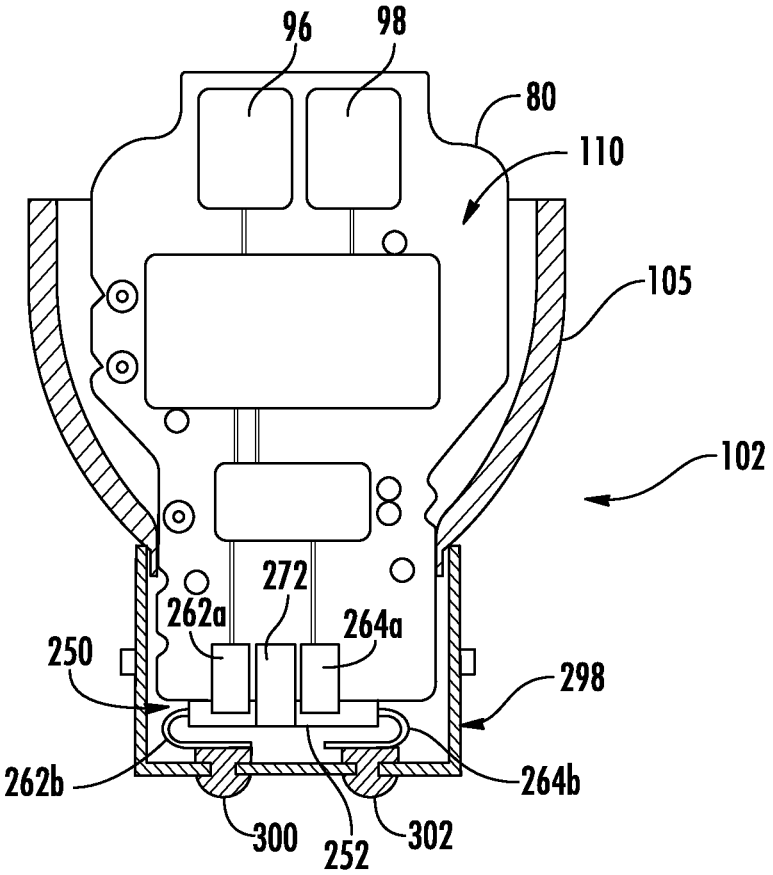
FIG. 21 is a partial section view showing the electronics board of the invention and another embodiment of the base electrical interconnect mounted in a second type of lamp base.

While the electrical interconnect has been described with reference to an Edison base, the base electrical interconnect as described herein may be used with any style of base, such as, but not limited to, single contact bayonet connectors, double contact bayonet connectors, pin connectors, wedge connectors or the like, where the base-side contacts 262*b*, 264*b* are configured to contact the electrical contacts of the base. FIG. 21 shows a double contact bayonet connector 298 where the contacts 300, 302 are contacted by the base-side contacts 262*b*, 264*b* as previously described. The base-side contacts 262*b*, 264*b* are configured to contact the base contacts 300, 302. It will be appreciated that the electrical interconnect, base-side contacts, and/or PCB may be configured to conform to the shape, size and configuration of the base with which the electrical interconnect is used. Moreover, a greater or fewer number of contacts may be provided on the electrical interconnect depending upon the configuration of the lamp electronics and/or the base contacts. Also, the electrical interconnect may be used with lamps or bulbs other than LED lamps.

Although specific embodiments have been shown and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. A lamp comprising:

an enclosure that a partially optically transmissive;

a base comprising an electrically insulating housing connected to an electrically conductive connector, the base defining an internal cavity;

a LED assembly comprising at least one LED, the LED assembly being located in the enclosure and the at least one LED operable to emit light when energized through an electrical path from the base;

an electronics board in the electrical path; and an electrical interconnect electrically coupling the electronics board to the base, the electrical interconnect being at least partially located in the internal cavity of the base, the electrical interconnect being separately mounted to the electronics board independently of the base and comprising an electrically insulated body including a deformable resilient member that is deformed into engagement with the electronics board such that a bias force is applied by the resilient member to the electronics board to create a mechanical engagement between the electrical interconnect and the electronics board by a snap-fit connection that secures the electrical interconnect electronics board, a first board-side contact and a second board-side contact supported on the body separate from deformable resilient member that are biased into engagement with an anode side and a cathode side of the electronics board, respectively, to create an electrical contact coupling, and a first base-side contact and a second base-side contact supported by the body that are configured to be biased into engagement with the electrically conductive connector to create an electrical contact coupling with the electrically conductive connector, the first base-side contact and the first board-side contact and the second base-side contact the second board-side contact extending through the insulated body.

2. The lamp of claim1 wherein one of the deformable resilient member and the electronics board comprises a protrusion and the other one of the deformable resilient member and the electronics board comprises a recess.

3. The lamp of claim 1 wherein the first board-side contact and the second board-side contact create an electrical connection to a first pad and a second pad of electron board.

4. The lamp of claim 3 wherein the first board-side contact and the second board-side contact are deformed engage the first pad and the second pad.

5. The lamp of claim 1 wherein the first base side contact and the second base side contact are deformed to engage the electrically conductive connector.

6. The lamp of claim 1 wherein the first base-side contact and the second base-side contact create electrical contact couplings with the electrically conductive connector.

7. The lamp of claim 1 wherein the electrically conductive connector comprises an Edison screw and the first based-side contact creates a first electrical contact coupling with an interior surface of the Edison screw and the second base-side contact creates a second electrical contact coupling with a centerline contact of the Edison screw.

8. The lamp of clam 1 wherein a guide is formed in the base to orient the electronics board relative to the base.

9. The lamp of claim 1 wherein he electronics board supports at least one of a driver and a power supply.

10. A method of making an LED lamp comprising:

providing an electronics board, a base, and a separate electrical interconnect, the electrical interconnect being a single component comprising a first board-side contact, a second board-side contact, a first base-side contact, second base-side contact and a resilient member; and the base comprising an electrically insulating housing and an electrically conductive connector, the base defining an internal cavity;

mounting the electrical interconnect onto the electronics board independently of the base to create an electrical contact coupling between the first board-side contact and the second board-side contact of the electrical interconnect and anode side and a cathode side of an electrical path on the electronics board by deforming the resilient member into engagement with the electronics board such that a bias force is applied by the resilient member to the electronics board to create a mechanical engagement between the electrical interconnect and the electronics board by a snap-fit connection that secures the electrical interconnect to the electronics board and biasing the first board-side contact d the second board-side contact into engagement with the electronics board; and after mounting the electrical interconnect onto the electronics board inserting the electronics board and the connected electrical interconnect into the internal cavity of the base, such that the first base side contact and the second base-side contact on the electrical interconnect are deformed by and create an eletrical contact coupling with the electrically conductive connector.

11. The method of claim 10 wherein the electrically conductive connector comprises an Edison screw and the first base-side contact and the second base side contact create the electrical contact coupling with the Edison screw.

12. A lamp comprising:

an enclosure that is at least partially optically transmissive;

a base;

a LED assembly comprising at least one LED, the LED assembly being located in the enclosure and the at least one LED operable to emit light when energized through an electrical path from the base;

an electronics board the electrical path;

an electrical interconnect electrically coupling the electronics board to the base, the electrical interconnect being separately mountable to the electronics board independently of the base and comprising an electrically insulated body including a deformable resilient member that is deformed into engagement with the electronics board such that a bias force is applied by the resilient member to the electronics board to create a mechanical engagement between, the electrical interconnect and the electronics board by a snap-fit connection, a first board-side contact and a second board-side contact supported on the body separate from the deformable resilient member that are biased into engagement with an anode side and a cathode side of the electronics board, respectively, to create an electrical contact coupling, and a first base-side contact and a second base-side contact supported by the body that are configured to be biased into engagement with the base to create an electrical contact coupling with the base, the first base-side contact and the first board-side contact and the second base-side contact and the second board-side contact extending through the insulated body; and a guide is formed in the base to orient the electronics board relative to the base.

* * * * *